United States Patent [19]

Leifeld

[11] Patent Number: 4,776,066

[45] Date of Patent: Oct. 11, 1988

[54] FIBER TUFT FEEDER

[75] Inventor: Ferdinand Leifeld, Kempen, Fed. Rep. of Germany

[73] Assignee: Trützschler GmbH & Co., KG, Monchen-Gladbach, Fed. Rep. of Germany

[21] Appl. No.: 53,825

[22] Filed: May 26, 1987

[30] Foreign Application Priority Data

May 24, 1986 [DE] Fed. Rep. of Germany ..... 3617527

[51] Int. Cl.[4] ..... D01G 23/06

[52] U.S. Cl. ..... 19/105; 19/106 R; 19/240

[58] Field of Search ..... 19/105, 106 R, 240, 19/300

[56] References Cited

U.S. PATENT DOCUMENTS

| | | | |
|---|---|---|---|
| 4,494,204 | 1/1985 | Hösel | 19/240 X |
| 4,520,531 | 6/1985 | Hergeth | 19/240 X |
| 4,530,134 | 7/1985 | Hösel | 19/300 X |
| 4,535,511 | 8/1985 | Leifeld | 19/240 X |
| 4,689,857 | 9/1987 | Pinto | 19/106 R |

FOREIGN PATENT DOCUMENTS

| | | |
|---|---|---|
| 0329412 | 5/1976 | Austria . |
| 2532061 | 2/1977 | Fed. Rep. of Germany . |
| 2264299 | 9/1978 | Fed. Rep. of Germany . |
| 3128532 | 7/1982 | Fed. Rep. of Germany . |
| 3239524 | 7/1983 | Fed. Rep. of Germany . |
| 3244619 | 10/1983 | Fed. Rep. of Germany . |
| 3513295 | 10/1986 | Fed. Rep. of Germany . |

*Primary Examiner*—Louis K. Rimrodt
*Attorney, Agent, or Firm*—Spencer & Frank

[57] ABSTRACT

An apparatus which feeds a fiber lap to a fiber processing machine has a reserve chute connected to a pneumatic fiber tuft conveying duct to receive fiber tufts therefrom; a feed chute connected to the reserve chute; a feed roller arranged for advancing fiber tufts from the reserve chute into the feed chute; a drive for rotating the feed roller; an arrangement for delivering a compressing air stream into the feed chute for densifying a fiber tuft column therein; a plurality of air outlet openings to provide a passage of the air stream out of the feed chute; a pressure sensor situated in the feed chute; a pressure regulator connected with the pressure sensor and the drive for altering the rpm of the feed roller as a function of the pressure prevailing in the feed chute. There are further provided a desired pressure value setter connected with the pressure regulator; a fill-level measuring device situated in the feed chute; a fill-level regulator operatively connected to the fill-level measuring device and the desired value setter of the pressure regulator for applying signals from the fill-level measuring device to the pressure regulating device via the fill-level regulator; and a common control device operatively connected to the fill-level regulator and the pressure regulator for receiving signals from the common control device.

6 Claims, 2 Drawing Sheets

FIBER TUFT FEEDER

BACKGROUND OF THE INVENTION

This invention relates to an apparatus for making a fiber lap from fiber tufts and feeding the fiber lap to a fiber processing machine such as a card, a roller card unit, a beater or the like. The feeder has a reserve chute receiving pneumatically conveyed fiber tufts and a feed chute receiving fiber tufts from the reserve chute. In the feed chute the fiber tufts are compressed by a fan-generated compressing air stream. The feed chute contains a pressure sensor which, by means of a pressure regulator, is connected with the controllable drive of a feed roller which advances fiber tufts from the reserve chute to the feed chute.

In order to be able to compress relatively large fiber tufts with a relatively small air resistance, a fan with a relatively large output is required. If in the same tuft feeder easily compressible fibers are to be processed, and particularly when the feeder is to operate alternately with two types of fiber tufts, according to prior art arrangements at the beginning of the fiber processing operation, the setting of the pressure sensor responding to the pressure in the feed chute is manually altered. The pressure sensor is connected by means of a regulator with the drive motor of the feed roller of the tuft feeder whereby the quantity of the fiber material supplied from the reserve chute to the feed chute is varied. In such an operational mode the fill-height (fill-level) of the fiber tuft column in the feed chute varies which also changes the extent to which fiber material covers the air outlet openings in the feed chute. It is a disadvantage of this arrangement that the actual fill-height deviates from a fill-height or a coverage of the air outlet openings by the fiber tufts which is optimal for the compression of the fiber tuft column in the feed chute.

SUMMARY OF THE INVENTION

It is an object of he invention to provide an improved fiber tuft feeder of the above-outlined type from which the discussed disadvantages are eliminated and which permits, particularly upon changing the type of fiber material or during operation, a setting for an optimal pneumatic compression of the fiber tufts in the feed chute.

This object and others to become apparent as the specification progresses, are accomplished by the invention, according to which, briefly stated, within the feed chute there is provided a fill-height sensing device which is connected, by means of a fill-level regulator, with a desired value setter of a pressure regulator and further, the fill-level regulator and the pressure regulator are connected to a common control apparatus.

A pressure determination by monitoring the coverage of air outlet openings by the fiber material in the feed chute is practical and advantageous in determining an unequivocal value for the feed chute pressure. From the point of view of output increase of the feeder the determination and setting of optimal operational conditions are particularly important. Controlled operational conditions in case of changing fiber materials are at high outputs possible only if such an automatic setting may be effected. Therefore, a change of the desired pressure value in the feed chute as a function of the coverage of air output openings of the feed chute by the fiber tufts is particularly significant. According to the invention, a self-seeking and self-determining desired value input for the pressure is effected. In particular, the self-setting of the operational conditions (fill-level and pressure) is effected in the feed chute of the tuft feeder. The apparatus acording to the invention provides for automatically finding the desired pressure value for the feed chute.

According to an advantageous feature of the invention, the fill-level measuring device comprises two superposed sensors which expediently are optical barriers. Preferably at least one of the optical barriers is situated above the level of the air outlet openings in the feed chute. Advantageously, there is provided a setting device at the pressure regulating device for the desired pressure value.

According to a further advantageous feature of the invention, a computer is provided which includes a memory and a control device for the regulators. Preferably, the computer stores a pressure value in the memory as a desired value, corresponding to a determined fill-level in the feed chute.

According to a further feature of the invention, the fill-level in the feed chute is monitored at least by one sensor situated in the zone of the upper boundary of the air outlet openings. In case two sensors (photocells) are used, it may be determined whether the desired fill-level is excessively high or excessively low. In case both photocells are dark, the fill-level is too high and if both photocells are light, the fill-level is too low. The desired value is obtained if only one photocell is dark. If both photocells are dark, the feed of fiber tufts into the feed chute is reduced. This arrangement serves to establish the basic setting for production start, and more particularly, for automatically seeking ideal operational conditions. This is particularly required if a machine or system is controlled by a microprocessor and all desired operational data are stored in a memory. The thus determined pressure in the feed chute is used as the desired pressure for supplying the feed chute.

The determination and release of the desired values are effected essentially by a self-monitoring of the system. The position of the top level of the fiber tuft column in relationship to the upper boundary of the air outlet openings is continuously determined by sensors. The column height has an ideal value and any deviation therefrom is monitored and recorded. By exceeding or falling below the ideal height the material supply to the feed chute is corrected by varying the speed of the feed roller which advances the fiber tufts from the reserve chute into the feed chute. If during a predetermined period the fill-level (that is, the top of the fiber tuft column) is situated in the ideal zone, the pressure prevailing during such period is held constant as a desired pressure and is utilized as a desired rpm (basic rpm) for the drive motor of the feed roller during that time period. Any further determination is promptly discontinued and the normal regulation activated for which the determined desired values are being utilized.

DESCRIPTION OF THE PREFERRED EMBODIMENTS

Figure 1:
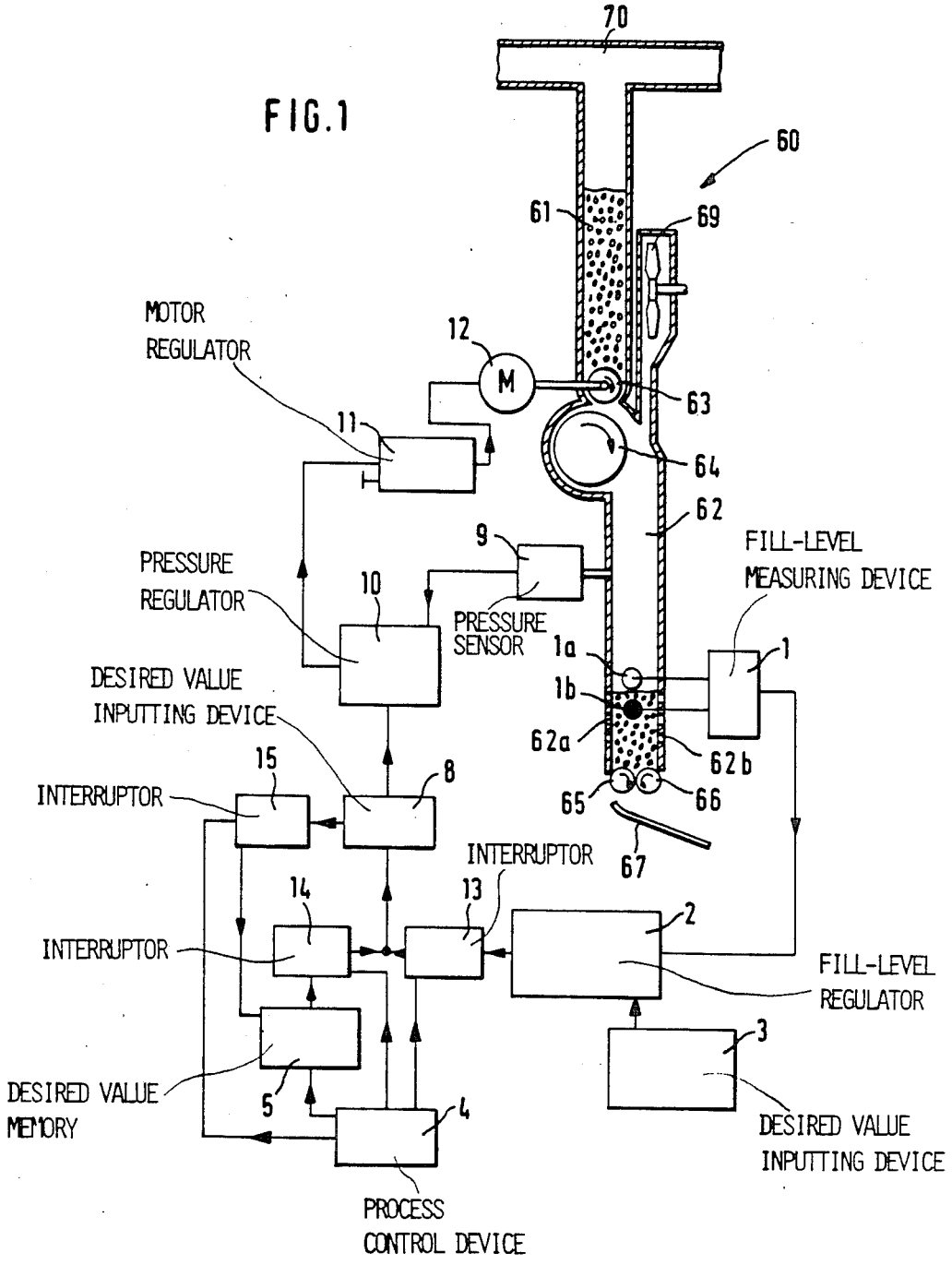
FIG. 1 is a schematic sectional side elevational view, with block diagram, of a preferred embodiment of the invention.

Turning to FIG. 1, there is shown therein a tuft feeder 60 which is known by itself and which may be, for example, an "EXACTAFEED FBK" model which supplies a fiber lap to an after-connected fiber lap processing machine such as a card which may be, for example, an "EXACTACARD DK 3" model, both manufactured by Trützschler GmbH & Co. KG, Mönchengladbach, Federal Republic of Germany. The tuft feeder 60 has an upper or reserve chute 61 and a lower or feed chute 62. A feed roller 63 and an opening roller 64 advance fiber material from the reserve chute 61 into the feed chute 62. At the lower, discharge end of the feed chute 62 there are provided cooperating discharging rollers 65 and 66 which withdraw the fiber material from the feed chute 62 as a fiber lap and advance the same on a transfer tray 67 to a card (not shown). The feed chute 62 is operatively connected with a fan 69 which generates an air stream which is introduced into the feed chute 62 and which serves for compressing (densifying) the fiber tufts in the feed chute 62. The reserve chute 61 is, at its input end, in communication with a common fiber tuft conveying duct 70 for receiving the fiber tufts—driven by a conveyor fan (not shown)—from an upstream-located fine opener (also not shown).

In the feed chute 62 there is situated a pressure-responsive device 9 such as an electronic pressure sensor which is connected by means of a pressure regulator 10 and a motor regulator 11 with the drive motor 12 of the feed roller 63. Within the feed chute 62 there is situated a fill-level measuring device 1 formed of two superimposed optical barriers 1*a* and 1*b*. The upper optical barrier 1*a* is situated above the series of air outlet openings 62*a*, 62*b* which are provided in the feed chute 62 and which serve for removing the compressing air supplied by the fan 69 for reintroduction thereof into the suction side of the fan 69. The fill-level measuring device 1 is connected by means of a fill-level regulator 2 with the pressure regulator 10. The fill-level regulator 2 and the pressure regulator 10 are connected to a common control device (process control) 4 which, in turn, is associated with an inputting and retrieving device (not shown). The control device 4 is a component of a microcomputer 16 which may be a Trützschler TMS model with a Rockwell 6502 microprocessor. With the fill-level regulating device 2 there is associated a desired value inputting device 3 for the desired fill-level value. The fill-level regulating device 2 is connected with the pressure regulator 10 by means of a desired value inputting device 8 for the desired pressure value. The control device 4 is connected with a desired value memory 5 and with first, second and third interruptors 13, 14 and 15, respectively. The interruptors 13, 14 and 15 are connected with the desired value inputting device 8 for the desired pressure value. The desired value memory 5 is connected with the interruptors 14 and 15.

Figure 2:
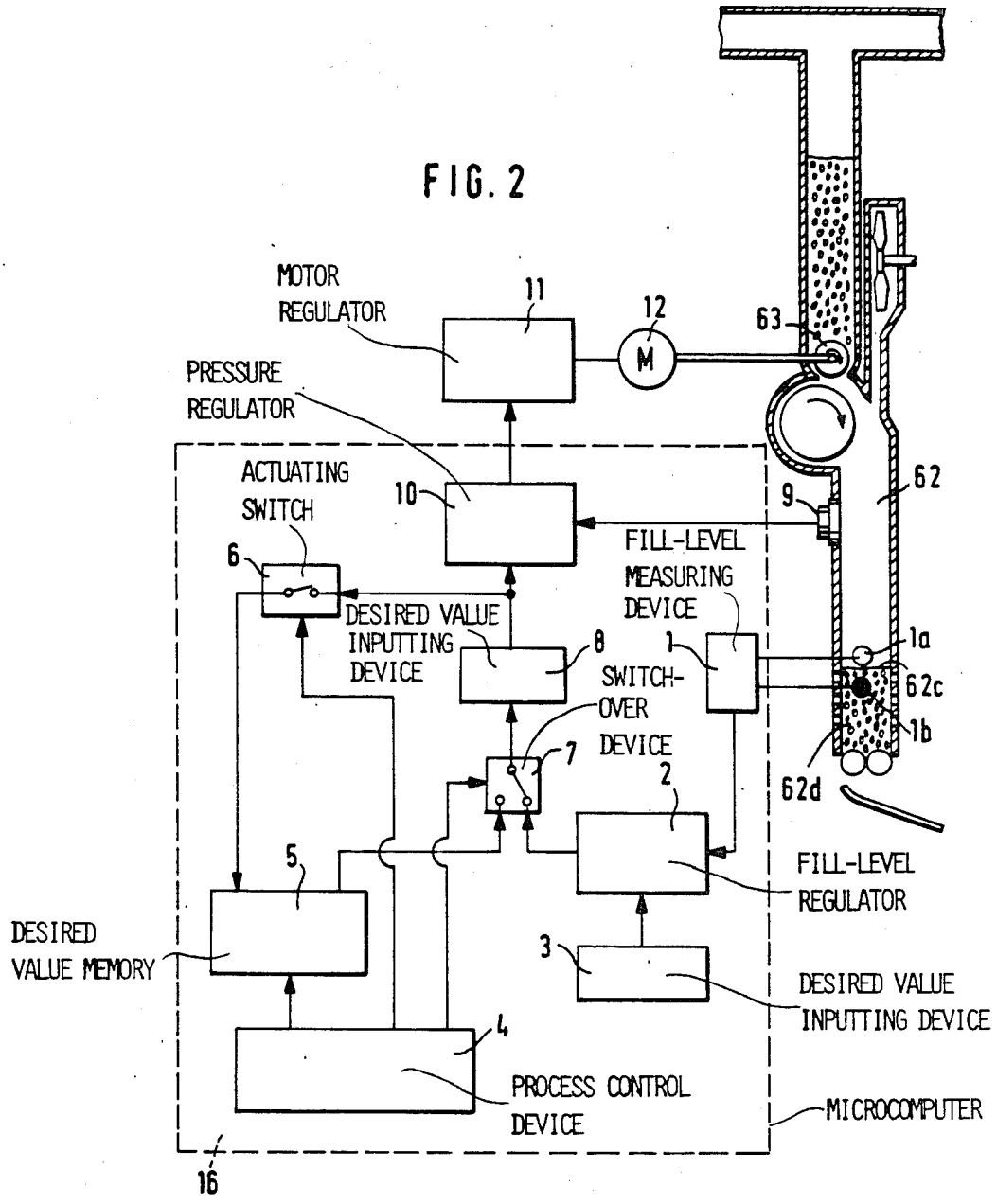
FIG. 2 is a schematic sectional side elevational view, with block diagram, of a second preferred embodiment of the invention.

Turning now to FIG. 2, the height level 62*c* of the fiber tuft column 62*d* in the feed chute 62 is situated between the lower and upper optical barriers 1*a* and 1*b* of the fill-level measuring device 1. Thus, the lower optical barrier 1*b* is dark. The optical barriers 1*a* and 1*b* are connected to a common device 1 for processing the electric signals emanating from the optical barriers 1*a* and 1*b* with which the fill-level regulator 2 is connected. In the wall of the feed chute 62 there is mounted the pressure-responsive device 9 which has a setting device and which is connected by means of a pressure regulator 10 with the motor regulator 11 for the drive motor 12 serving the feed roller 63. The fill-level sensor 1 applies its output to the fill-level regulator 2 which, in turn, is connected with a desired value inputting device 3 for the fill-level. The fill-level regulator 2 is connected by means of a switch-over device 7 and a desired pressure value inputting device 8 with the pressure regulator 10. The control device 4 is connected with the switch-over device 7, an actuating switch 6 and a desired value memory 5. The actuating switch 6 is connected with the desired value memory 5, the desired value preselector (inputter) 8 and the pressure regulator 10.

The system according to the invention thus has two measuring components, namely, the fill-level measuring device 1 and the pressure sensor 9. Furthermore, there are provided three regulators, namely, the fill-level regulator 2, the pressure regulator 10 and the motor regulator 11. The setting member is constituted by the motor 12 for the feed roller 63. In case of pressure or fill-level fluctuations in the feed chute 62 the rpm of the feed roller 63 is changed whereby the quantity of the fiber tufts introduced into the feed chute 62 is altered.

During operation, for an automatic setting of the fiber tuft feeder the following process steps are carried out:

As the machine operates, one or more optical barriers or equivalent height sensors respond to the fill-level in the feed chute 62 in the zone of the upper boundary of the air outlet openings 62*a*, 62*b*. Dependent upon the sensed condition, the rpm of the feed roller 63 is altered until, throughout a determined period of observation, the coverage of the outlet openings 62*a*, 62*b* by the fiber tufts reaches an ideal height which is approximately 10–20 mm below the top boundary of the openings. The desired value is expediently altered only in a range of between approximately 30 and 59 mm water column pressure. When the alteration of the desired value for the pressure is not sufficient, the rpm of the feed roller 63 is varied by its drive motor 12 until the above-noted ideal coverage of air outlet openings is reached. A further fine tuning may be effected by producing an ideal coverage of air outlet openings at an approximately 40 mm water column pressure.

The invention has been disclosed in particular in conjunction with an example for machines in the spinning preparation. It is to be understood that it may find application in all other fiber processing machines where the input material is a fiber lap.

The present disclosure relates to subject matter contained in Federal Republic of Germany Patent Application No. P 36 17 527.7 (filed May 24th, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an apparatus for feeding a fiber lap to a fiber processing machine; the apparatus having a reserve chute connected to a pneumatic fiber tuft conveying duct to receive fiber tufts therefrom; a feed chute connected to said reserve chute; a feed roller arranged for advancing fiber tufts from the reserve chute into the feed chute; drive means for rotating the feed roller; means for delivering a compressing air stream into the feed chute for densifying a fiber tuft column therein; said tuft column having a top face constituting a fill level of the feed chute; means defining a plurality of air outlet openings to provide a passage of the air stream out of said feed chute; a pressure sensor situated in the feed chute; a pressure regulator connected with the pressure sensor and said drive means for altering the rpm of said feed roller as a function of the pressure prevailing in the feed chute; the improvement comprising (a) a desired pressure value setter connected with said pressure regulator;

(b) a fill-level measuring device situated in said feed chute;

(c) a fill-level regulator operatively connected to the fill-level measuring device and the desired value setter of said pressure regulator for applying signals from said fill-level measuring device to said pressure regulating device through said fill-level regulator;

(d) a common control device operatively connected to said fill-level regulator and said pressure regulator for receiving signals from said common control device.

2. An apparatus as defined in claim 1, wherein said fill-level measuring device comprises two vertically spaced sensors.

3. An apparatus as defined in claim 2, wherein said vertically spaced sensors comprise optical barriers.

4. An apparatus as defined in claim 2, wherein said air outlet openings have an upper boundary; at least one of said sensors is situated at a level above said upper boundary.

5. An apparatus as defined in claim 1, further comprising a computer including said common control device and a memory connected to said common control device.

6. An apparatus as defined in claim 5, wherein said computer is arranged for generating a signal when a predetermined fill level is sensed by said fill-level measuring device and for applying said signal to said memory as a desired pressure value.

* * * * *